US008739839B2

(12) United States Patent
Muller

(10) Patent No.: US 8,739,839 B2
(45) Date of Patent: Jun. 3, 2014

(54) REFILLABLE TRAVEL DISPENSER

(75) Inventor: Patrick Muller, Saint Aubin sur Gaillon (FR)

(73) Assignee: Aptar France S.A.S., Le Neubourg (FR)

( * ) Notice: Subject to any disclaimer, the term of this patent is extended or adjusted under 35 U.S.C. 154(b) by 0 days.

(21) Appl. No.: 13/554,282

(22) Filed: Jul. 20, 2012

(65) Prior Publication Data

US 2013/0019991 A1 Jan. 24, 2013

Related U.S. Application Data

(60) Provisional application No. 61/539,253, filed on Sep. 26, 2011.

(30) Foreign Application Priority Data

Jul. 21, 2011 (FR) ..... 11 56610

(51) Int. Cl.

| | |
|---|---|
| ***B65B 1/04*** | (2006.01) |
| ***B65B 3/04*** | (2006.01) |
| ***B65D 37/00*** | (2006.01) |
| ***B65D 88/54*** | (2006.01) |
| ***B05B 11/00*** | (2006.01) |

(52) U.S. Cl.

USPC ..... 141/18; 141/23; 141/26; 141/113; 222/207; 222/321.9; 222/385

(58) Field of Classification Search

USPC ..... 141/2, 18, 21–23, 25–28, 113, 324, 141/379, 380; 222/207, 321.5–321.9, 385; 137/572

See application file for complete search history.

(56) References Cited

U.S. PATENT DOCUMENTS

| | | | | |
|---|---|---|---|---|
| 7,743,949 | B2 * | 6/2010 | Ramet | 222/321.9 |
| 8,079,388 | B2 * | 12/2011 | Turgeman | 141/113 |
| 2005/0211731 | A1 * | 9/2005 | Ramet | 222/321.9 |

FOREIGN PATENT DOCUMENTS

EP 1 579 924 A1 9/2005

OTHER PUBLICATIONS

French Preliminary Search Report of FR 1156610 dated Mar. 13, 2012.

* cited by examiner

*Primary Examiner* — Timothy L Maust
*Assistant Examiner* — Brandon J Warner
(74) *Attorney, Agent, or Firm* — Sughrue Mion, PLLC

(57) ABSTRACT

A refillable travel dispenser having a fluid reservoir (1) including a top end that forms a neck (21), and a bottom end that forms a filling orifice (22) that is closed by a valve member (4); a pump (5) mounted on the top end of the reservoir (1); and a pusher mounted on the pump so as to actuate it. The reservoir (1) defines two internal compartments (C1, C2) that communicate with each other via an upper passage (31) situated in the proximity of the top end of the reservoir, and a lower passage (44) that is situated in the proximity of the bottom end of the reservoir, the valve member (4) being movable between a rest first seat (23) that closes the orifice (22) of the reservoir and a filling second seat (34) that closes the lower passage (44) during a filling step for filling the reservoir.

14 Claims, 3 Drawing Sheets

REFILLABLE TRAVEL DISPENSER

CROSS REFERENCE TO RELATED APPLICATION

This application claims the benefit under 35 U.S.C. §119 (e) of pending U.S. provisional patent application Ser. No. 61/539,253, filed Sep. 26, 2011, and priority under 35 U.S.C. §119(a)-(d) of French patent application No. FR-11 56610, filed Jul. 21, 2011.

The contents of the foregoing applications are incorporated herein by reference in their entirety.

TECHNICAL FIELD

The present invention relates to a refillable travel dispenser comprising a fluid reservoir that is associated with a manual pump. Travel dispensers are low-capacity dispensers that can easily be carried, in particular while traveling. Advantageous fields of application of the present invention are the fields of perfumery, cosmetics, or even pharmacy.

"Travel" dispensers are used increasingly in the field of perfumery so as to enable users to apply the same perfume as the perfume of the dispenser that is left at home. Conventional dispensers include a medium-capacity reservoir, such that carrying such dispensers is not always easy. In addition, current regulations on air transport greatly limit the quantity of liquid that may be taken on-board. The size of a travel dispenser is specially adapted to enable it to be carried easily and to comply with regulations. The size of such travel dispensers is small as a result of the small capacity of their fluid reservoirs. This is why it is necessary to be able to fill them easily when they are empty.

BACKGROUND OF THE INVENTION

In the prior art, travel dispensers are already known that have a reservoir that has a filling orifice that is provided with a check valve. The check valve may be forced into its open position by an actuator rod of a pump or an aerosol dispenser valve that is mounted on a fluid supply. With an aerosol dispenser valve, it suffices to press the filling orifice of the travel dispenser on the actuator rod of the valve of the supply, so as to enable the reservoir of the travel dispenser to be filled continuously. With a dispenser pump, it is necessary to move the travel dispenser axially down and up several times on the actuator rod of the pump of the supply. Either way, the fluid supply is fitted with a pump or includes internal aerosol drive pressure, and it is the travel dispenser as a whole that must be moved, so as to drive the actuator rod of the aerosol valve or of the pump.

BRIEF SUMMARY OF THE INVENTION

An object of the present invention is to define a refillable travel dispenser of another type having a filling action that is different from the filling action of the above-mentioned prior art. More precisely, an object of the present invention is to fill the reservoir of the travel dispenser merely by actuating the pump of the travel dispenser, as when it is being used normally to dispense fluid. As a result, the user merely places the travel dispenser on the fluid supply or source (that does not have a pump or aerosol pressure), and presses on the pusher of the pump of the travel dispenser, with the actuation of the pusher causing the reservoir of the travel dispenser to be filled.

To do this, the present invention proposes a refillable travel dispenser comprising: a fluid reservoir comprising a top end that forms a neck, and a bottom end that forms a filling orifice that, at rest, is closed by a valve member; a pump that is mounted on the top end of the reservoir so as to take fluid; and a pusher that is mounted on the pump so as to actuate it; the dispenser being characterized in that the reservoir defines two internal compartments that communicate with each other via an upper passage that is situated in the proximity of the top end of the reservoir, and a lower passage that is situated in the proximity of the bottom end of the reservoir, the valve member being movable between two seats, a rest first seat that closes the orifice of the reservoir, and a filling second seat that closes the lower passage during a step of filling the reservoir. In other words, the two compartments communicate with each other via two passages, one of which is closable selectively by means of the valve member that closes the filling orifice of the reservoir. Thus, when the valve member is in its rest position, both passages are open and the reservoir behaves as if the reservoir is not compartmentalized, whereas during a step of filling the reservoir, the two compartments communicate only via the upper passage, and the fluid sucked through the open filling orifice can thus fill one of the compartments until the level of the fluid reaches the level of the upper passage that connects the two compartments together. At that moment, the travel dispenser may be removed from its fluid supply or source, thereby causing the filling orifice to be closed by the valve member and the lower passage to be opened, thereby putting the two compartments into communication.

According to an advantageous characteristic of the invention, the lower passage may be formed by the valve member. Thus, it is the movement of the valve member forming the lower passage that enables the lower passage to close.

In a practical embodiment, the compartments may be defined by an inner bushing that is disposed in an outer shell, thereby defining an inner compartment and an outer compartment that surrounds the inner compartment at least in part. Advantageously, the bushing defines the upper passage. Advantageously, the bushing defines the filling seat of the valve member. The bushing may also serve to guide the valve member between the two seats.

Thus, the pump mainly communicates with the outer compartment via the lower passage when the valve member closes the filling orifice. In addition, the pump communicates with the outer compartment via the upper passage when the lower passage is closed.

In another advantageous aspect of the present invention, the pump extends into the inner compartment and includes a dip tube that extends into the proximity of the valve member. The dip tube may advantageously serve to guide the valve member axially between the two seats.

In a practical embodiment, the bushing defines an annular bottom edge that forms the filling seat, the bottom edge being disposed at a distance from a top edge of the filling orifice that forms the rest seat, the valve member being movable between the two seats against the force of a spring that urges it into contact with the rest seat. The spring may advantageously be guided by the dip tube of the pump.

One of the principles of the present invention is to compartmentalize the reservoir of the refillable travel dispenser so as to be able to fill one of the compartments of the reservoir by means of the pump of the travel dispenser without causing fluid to be dispensed. This is achievable given that the suction generated by the pump of the travel dispenser is transmitted to the compartment that is being filled with fluid, via the other compartment that remains empty, until the level of the compartment that is being filled reaches the upper passage that puts the two compartments into communication. From that moment on, the empty compartment begins to fill and the pump thus begins to dispense fluid. It is thus time to stop filling the travel dispenser by removing it from its fluid supply or source. Removing the travel dispenser causes the filling orifice to close and the lower passage to open, thereby putting the two compartments into communication. The fluid levels in the two compartments of the reservoir thus come into balance in accordance with the law of communicating vessels.

BRIEF DESCRIPTION OF THE DRAWINGS

The invention is described more fully below with reference to the accompanying drawings, which show an embodiment of the invention by way of non-limiting example.

In the figures.

DETAILED DESCRIPTION

Figure 1:
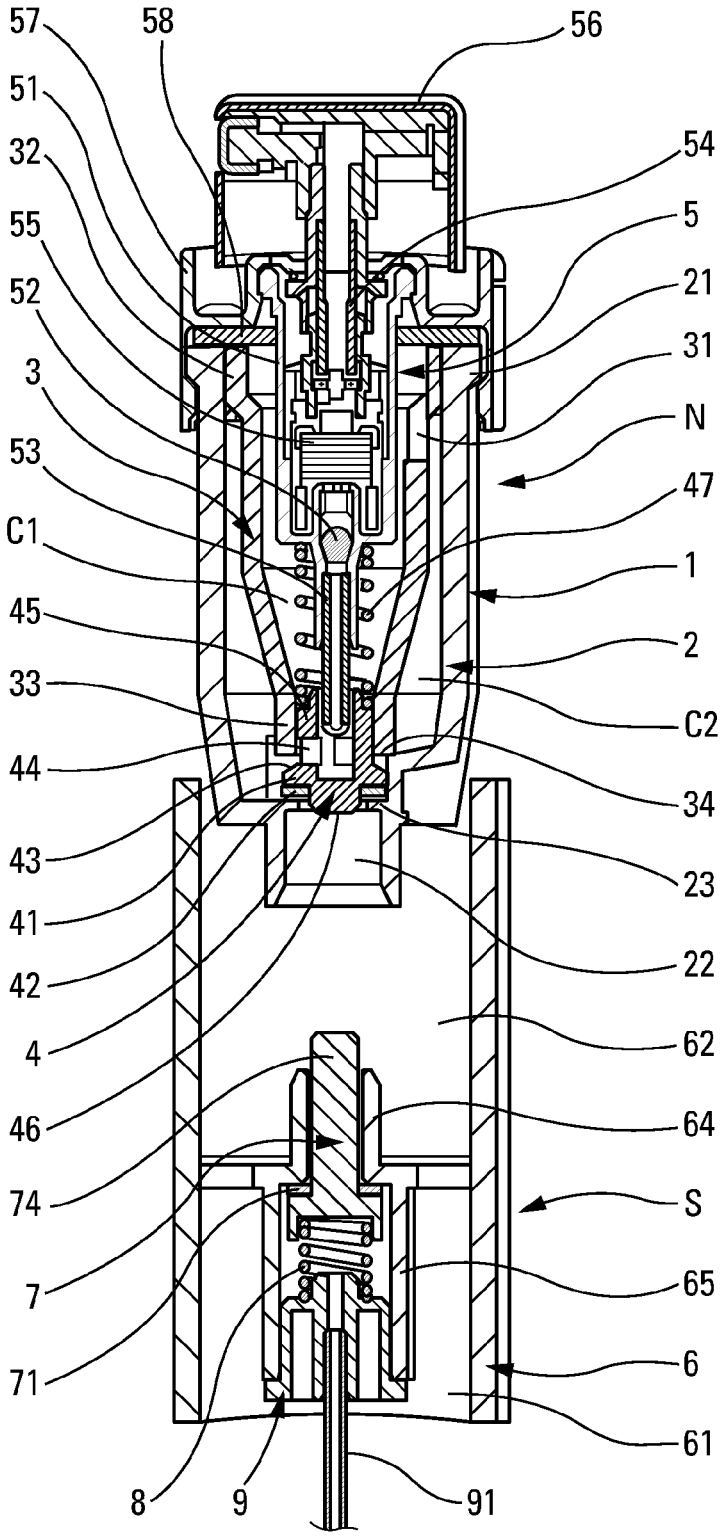
FIG. 1 is a vertical-section view through a refillable travel dispenser of the invention, ready to be placed on a fluid supply or source.
Figure 2:
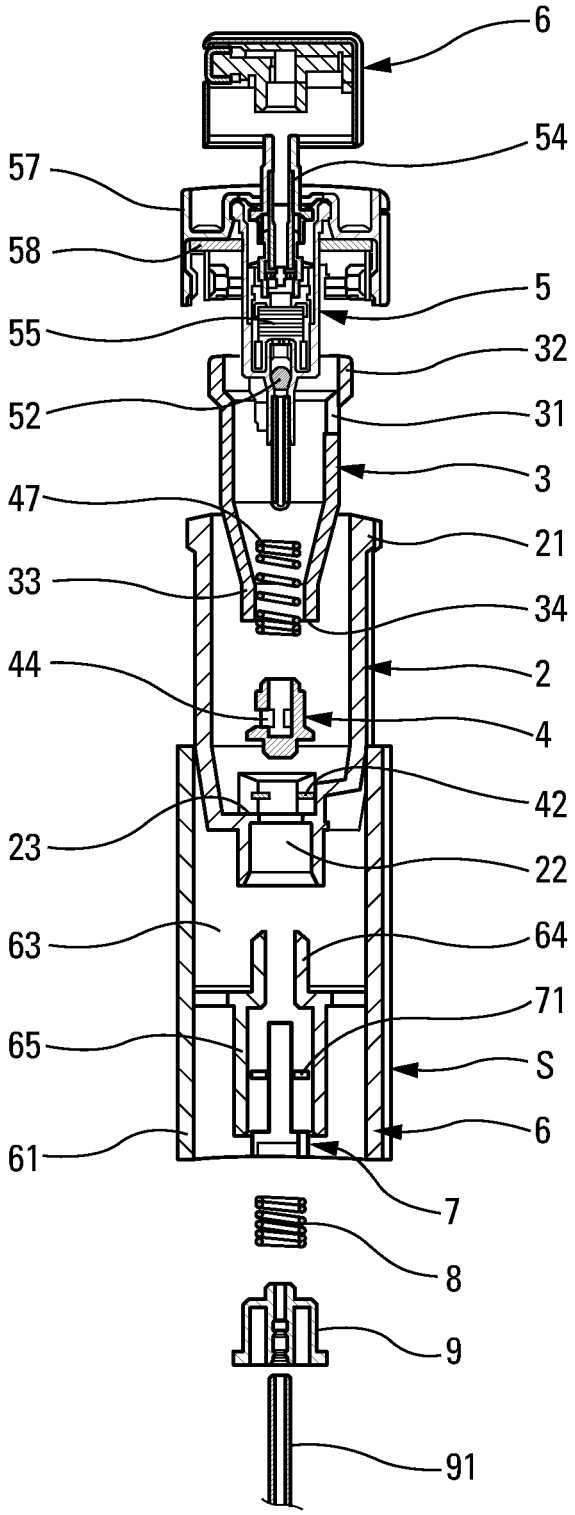
FIG. 2 is an exploded view of FIG. 1.

The refillable travel dispenser, designated overall by the letter N, comprises two sub-assemblies, namely: a fluid reservoir 1; and a pump 5 that is mounted on the reservoir 1 in stationary and leaktight manner, and advantageously in permanent manner. In order to refill the travel dispenser with fluid, i.e. fill its reservoir 1 with fluid, it is associated with a fluid supply or source S that advantageously does not have a pump or aerosol pressure. The fluid source S is merely provided with an outlet-valve member 7 that is urged by a spring 8 in such a manner as to compress a sealing gasket 71. A dip tube 91 makes it possible to deliver fluid to the outlet-valve member 7. The structure of a non-limiting embodiment of the fluid source S is explained below.

The fluid reservoir 1 of the refillable travel dispenser N comprises three essential component elements, namely: an outer shell 2; an inner bushing 3; and a valve member 4. The three elements may be made by injection-molding appropriate plastics material.

The outer shell 2 includes an open top end that defines a neck 21 that serves to fasten the pump 5, as described below. At its bottom end, the outer shell 2 forms a filling orifice 22 that forms a top edge that serves as a rest valve seat 23. Naturally, the outer shell 2 is hollow so as to define an inner space that receives the inner bushing 3, the valve member 4, and a fraction of the pump 5, as described below.

The inner bushing 3 includes a top end that forms a collar 32 that is engaged in stationary and permanent manner inside the neck 21 of the outer shell 2. Just below the holding collar 32, the inner bushing 3 defines one or more upper passages 31 that pass(es) through the wall thickness of the bushing. Below the passage(s) 31, the bushing extends in cylindrical, then frustoconical, manner, so as to define a bottom end 33 that forms an annular edge that serves as a filling valve seat 34. The seat 34 is situated at a distance above the seat 23 formed by the outer shell 2. The bushing may include a bottom portion that is in engagement with the shell 2, so as to center the bushing in the shell. Thus, the inner bushing 3 extends inside the outer shell 2 in such a manner as to define two compartments, namely: an inner compartment C1 that is defined inside the bushing 3; and an outer compartment C2 that is defined between the bushing and the shell. It is stated above that, in the top portion of the reservoir, the two compartments C1, C2 communicate with each other via the upper passage(s) 31. It is explained below that they also communicate in selective manner via another passage that is situated in the bottom portion of the reservoir.

Figure 3:
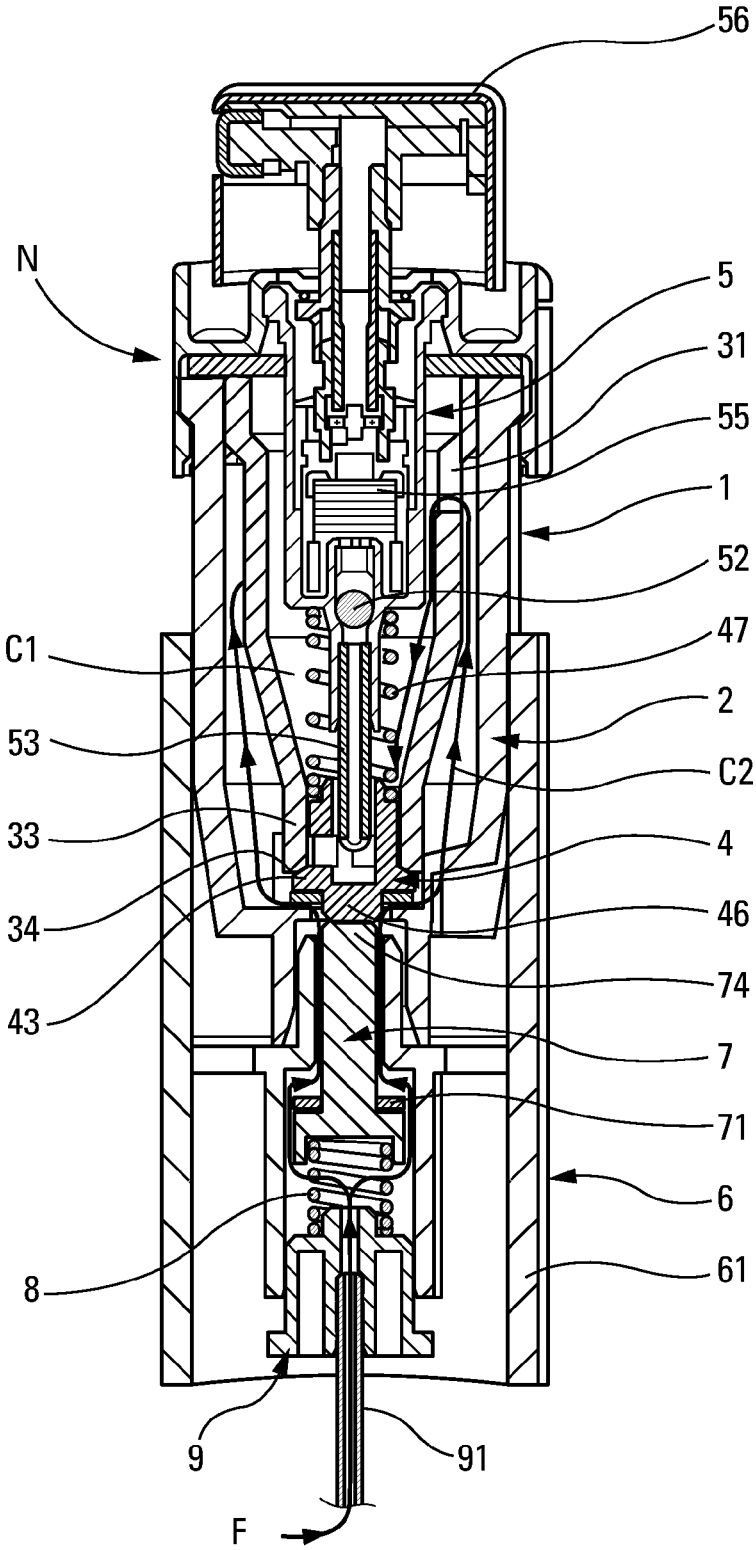
FIG. 3 is a view similar to the view in FIG. 1 with the refillable travel dispenser in engagement with the fluid supply or source, so as to fill the reservoir of the travel dispenser.

The valve member 4 comprises a hollow tube 45 that is slidably engaged inside the bottom end 33 of the bushing 3. The tube 45 includes one or more side openings defining one or more lower passages 44. Below the lower passage(s) 44, the valve member 4 defines a sealing collar 41 that may optionally be provided with a sealing gasket 42 for compressing in leaktight manner against the rest seat 23 formed by the outer shell 2. The upper collar portion 43 of the sealing collar 41 is also for coming into leaktight contact with the bottom edge of the bushing 3 that forms the filling seat 34. The valve member 4 also includes a bottom thrust surface 46 for coming into engagement with a thrust pin that is formed by the fluid supply or source S, as described below. Thus, the valve member 4 may move axially inside the bushing 3 between the rest seat 23 and the filling seat 34. In the rest position shown in FIG. 1, the valve member 4 is urged by a spring 47 that is disposed inside the bushing 3 and that bears against the top end of the tube 45, in such a manner as to urge the valve member 4 against the rest seat 23 of the shell 2. It should be observed that in the rest position, the two compartments C1 and C2 communicate with each other not only via the upper passage(s) 31, but also via the lower passage(s) 44 formed by the valve member 4. However, when the valve member 4 is thrust into leaktight contact against the filling seat 34 against the force of the spring 47, the lower passage(s) 44 is/are closed, but the filling orifice 22 then communicates with the reservoir, and more particularly with the outer compartment C2. This is shown in FIG. 3.

One of the inventive principles of the present invention resides in this particular arrangement of the reservoir.

The pump 5 may be of entirely conventional design, including a pump body 51 that is provided with an inlet valve member 52 and with a dip tube 53 that has its bottom end extending into the tube 45 of the valve member 4. The return spring 47 of the valve member 4 extends around the dip tube 53 bearing against the underside of the pump body 51. The pump also includes an actuator rod 54 that is axially movable down and up inside the pump body, in such a manner as to cause the volume of a pump chamber 55 to vary. The pump also includes a pusher 56 on which the user may press by means of one or more fingers, so as to move the actuator rod 54 and thus dispense fluid from the reservoir 1. In order to fasten the pump 5 on the reservoir 1, a fastener ring 57 is provided that comes into engagement around the neck 21, and that may advantageously be provided with annular reinforcement for attachment purposes. A snap-fastener or crimping ring may also be used. Sealing may be provided by a neck gasket 58 that is flattened against the top edge of the outer shell 2 by an annular disk that is formed by the ring 57. This design is entirely conventional for a pump in the fields of perfumery, cosmetics, or even pharmacy. The only distinctive feature resides in the fact that the dip tube extends into the valve member 4, and that the return spring 47 extends around the dip tube 53 that may thus serve to guide the spring axially. It should be observed that a portion of the pump 5 extends inside the inner bushing 3 in the inner compartment C1. In a variant that is not shown, the pump body 51 may extend into the bottom portion of the bushing 3, and even into the valve member 4, forming an elongate inlet duct, for example.

When the valve member 4 is in its rest position, as shown in FIG. 1, the pump communicates with the outer compartment C2 mainly via the valve member 4, and more particularly via the tube 45 and the lower passage(s) 44. The fluid level inside the two compartments C1 and C2 is identical, in accordance with the law of communicating vessels, given that the lower passage(s) 44 is/are open. However, when the valve member 4 is in leaktight contact against the filling seat 34, the two compartments C1 and C2 communicate only via the upper passage(s) situated in the top portion of the reservoir. The fluid levels inside the two compartments may thus be different. This principle is used by the present invention for selectively making it possible to dispense fluid under normal working condition and to fill the reservoir during the filling step.

The fluid supply or source S usable in combination with the refillable travel dispenser of the invention may be of any kind, but it preferably does not include aerosol pressure or a pump. The fluid source S shown in the figures includes a main casing 6 that, in its bottom portion, defines a fluid storage volume 61, and in its top portion, defines a reception housing 62 for receiving the reservoir 1 of the travel dispenser N so as to fill it. The casing 6 includes a connection sleeve 64 for penetrating into the filling orifice 22 in leaktight manner. The casing 6 also includes an outlet-valve-member support 65 in which there is housed an outlet-valve member 7 that is optionally provided with a sealing gasket 71. The valve-member support 65 also contains a spring 8 for urging the valve member 7 into its leaktight rest position. The spring 8 bears against an insert 9 that is force-fitted in the support 65. The insert 9 also serves to interfit a dip tube 91 that extends into the fluid of the source S. Instead of the source S, it is also possible to use a source that is provided with a pump or aerosol pressure, or even a source that is provided with a flexible hose that is connectable to the travel dispenser N.

In the invention, the valve member 7 forms an opening pin 74 that is for coming into contact with the bearing surface 46 of the valve member 4, as can be seen in FIG. 3, so as to urge said valve member 4 into its open position. The springs 47 and 8 are thus compressed in such a manner as to open the two valve members 4 and 7, respectively. The opening sequence of the valve members 4, 7 is dependent on the respective stiffnesses of the springs 47, 8. Once the two valve members are open, a communicating passage is established between the source S and the pump 5. The passage extends through the dip tube 91 of the source S, around the outlet-valve member 7, through the filling orifice 22, between the valve member 4 and the rest seat 23, around the inner bushing 3 in the outer compartment C2, through the upper passage(s) 31, and into the inner compartment C1 so as to reach the dip tube 53 of the pump 5. Thus, by actuating the pusher 56, the pump creates suction in the reservoir, and more particularly in the inner compartment C1, the suction communicating as far as the fluid source S. The suction thus sucks the fluid from the source S in such a manner as to reach the outer compartment C2. The outer compartment C2 fills until the level of fluid reaches the upper passage(s) 31 communicating with the inner compartment C1. The fluid thus falls by gravity into the compartment C1 and begins to fill it until the fluid is sucked by the pump so as to be dispensed through the pusher. At this moment, the outer compartment C2 is known to be full of fluid. The actuation of the pusher may stop and the travel dispenser N may be removed from its source S. On being removed, the pin 74 of the outlet-valve member 7 relaxes its pressure on the valve member 4 which returns into its leaktight rest position on its rest seat 23. Simultaneously, the lower passage(s) 44 open, thereby putting the two compartments C1 and C2 into communication, and thereby balancing the fluid levels in the two compartments in accordance with the law of communicating vessels. Although the reservoir is not completely full, it is sufficiently full to enable a plurality of doses to be dispensed. Once filled, the capacity of the reservoir is substantially equal to the maximum capacity of the outer compartment C2. Naturally, by optimizing the configuration of the inner bushing 3, it is possible to reduce the volume of the inner compartment C1 as much as possible, and to increase the volume of the outer compartment C2 as much as possible.

By means of the invention, a travel dispenser is provided from which fluid is dispensed and into which fluid is refilled by means of the same action, i.e. actuation of its pump.

What is claimed is:

1. A refillable travel dispenser comprising:

a fluid reservoir comprising a top end that forms a neck, and a bottom end that forms a filling orifice that, at rest, is closed by a valve member;

a pump that is mounted on the top end of the reservoir so as to take fluid, wherein the pump includes a chamber and wherein the pump is contained at least in part within the reservoir; and a pusher that is mounted on the pump so as to actuate the pump;

wherein the reservoir defines two internal compartments outside of the pump and that communicate with each other via at least one upper passage that is situated in the proximity of the top end of the reservoir, and at least one lower passage that is situated in the proximity of the bottom end of the reservoir, the valve member being movable between two seats, a rest first seat that closes the orifice of the reservoir, and a filling second seat that closes the lower passage during a filling step for filling the reservoir.

2. The dispenser according to claim 1, wherein the lower passage is formed by the valve member.

3. The dispenser according to claim 1, wherein the compartments are defined by an inner bushing that is disposed in an outer shell, thereby defining an inner compartment and an outer compartment that surrounds the inner compartment, at least in part.

4. The dispenser according to claim 3, wherein the bushing defines the upper passage.

5. The dispenser according to claim 3, wherein the bushing defines the filling seat of the valve member.

6. The dispenser according to claim 3, wherein the pump mainly communicates with the outer compartment via the lower passage when the valve member closes the filling orifice.

7. The dispenser according to claim 3, wherein the pump communicates with the outer compartment via the upper passage when the lower passage is closed.

8. The dispenser according to claim 3, wherein the pump extends into the inner compartment and includes a dip tube that extends into the proximity of the valve member.

9. The dispenser according to claim 3, wherein the bushing defines an annular bottom edge that forms the filling seat, the bottom edge being disposed at a distance from a top edge of the filling orifice that forms the rest seat, the valve member being movable between the two seats against the force of a spring that urges it into contact with the rest seat.

10. The dispenser according to claim 1, wherein the valve member comprises a hollow tube that is slidably engaged inside the bushing, the tube including at least one side opening defining said at least one lower passage, the valve member defining a sealing collar for engaging in leaktight manner against the rest seat, the collar also coming into leaktight contact with the filling seat, the valve member also including a bottom thrust surface for coming into engagement with a thrust pin that is formed by a fluid source.

11. The dispenser according to claim 10, wherein the sealing collar comprises a sealing gasket for compressing in a leaktight manner against the rest seat.

12. A refillable travel dispenser comprising:

a fluid reservoir comprising a top end that forms a neck, and a bottom end that forms a filling orifice that, at rest, is closed by a valve member;

a pump mounted on the top end of the reservoir so as to take fluid; and a pusher mounted on the pump so as to actuate the pump;

the reservoir defines two internal compartments outside of the pump and that communicate with each other via an upper passage located at or proximate of the top end of the reservoir, and a lower passage located at or proximate the bottom end of the reservoir, the valve member shuttles between two seats, a rest first seat that closes the orifice of the reservoir, and a filling second seat that closes the lower passage during a filling step for filling the reservoir.

13. The dispenser according to claim 12, wherein the valve member comprises a bottom part that seals against the rest first seat and a top part that seals against the filling second seat.

14. The dispenser according to claim 12, wherein the pump extends at least partially within one of the two internal compartments.

* * * * *